US006177201B1

(12) United States Patent
Wallace et al.

(10) Patent No.: US 6,177,201 B1
(45) Date of Patent: Jan. 23, 2001

(54) PORCELAIN ENAMEL COATING FOR HIGH-CARBON STEEL

(75) Inventors: Roger Alan Wallace, Crittenden, KY (US); Ming Cheng Kuo, Fox Point, WI (US)

(73) Assignee: A. O. Smith Corporation, Milwaukee, WI (US)

( * ) Notice: Under 35 U.S.C. 154(b), the term of this patent shall be extended for 0 days.

(21) Appl. No.: 09/334,839

(22) Filed: Jun. 17, 1999

Related U.S. Application Data

(60) Provisional application No. 60/089,645, filed on Jun. 17, 1998.

(51) Int. Cl.[7] ..... B05B 3/02

(52) U.S. Cl. ..... 428/472; 427/372; 427/375; 427/376.1; 427/376.2; 427/402; 427/419.2; 427/419.3; 427/419.4; 428/212; 428/428; 428/469; 428/697; 428/699; 428/701; 428/702

(58) Field of Search ..... 428/42, 469, 472, 428/336, 697, 701, 702, 699, 332, 428; 427/372.2, 375, 376.1, 376.2, 402, 419.2, 419.3, 419.4

(56) References Cited

U.S. PATENT DOCUMENTS

| | | | |
|---|---|---|---|
| 2,755,210 | 7/1956 | Sutphen et al. | 148/16 |
| 2,940,865 | 6/1960 | Sullivan | 117/23 |
| 3,011,906 | 12/1961 | Davis et al. | 117/50 |
| 3,765,931 | 10/1973 | Kyri et al. | 117/129 |
| 3,956,536 | 5/1976 | Schoenemann et al. | 427/328 |
| 4,012,239 | 3/1977 | Brun et al. | 148/6.3 |
| 4,064,311 | 12/1977 | McLean et al. | 428/434 |
| 4,250,215 | 2/1981 | Mayer | 428/35 |
| 4,460,630 | 7/1984 | Nishino et al. | 427/376.2 |
| 5,266,357 | 11/1993 | Preuss et al. | 427/376.5 |
| 5,296,415 | 3/1994 | Podesta | 501/25 |
| 5,516,586 | 5/1996 | Singer et al. | 428/433 |
| 5,547,768 | 8/1996 | Topolski et al. | 428/632 |

OTHER PUBLICATIONS

TI Vitreous Enamels Ltd and University of Leeds, "Vitreous Enamelling, A Guide to Modern Enamelling Practice", pp. 20–27, 36, 50–59—published sufficiently before filing date such that the month is not an issue.

*Primary Examiner*—Archene Turner
(74) *Attorney, Agent, or Firm*—Michael Best & Friedrich LLP

(57) ABSTRACT

A porcelain enamel coating suitable for use on high-carbon content, heat-rolled sheet steel is provided. The coating includes a ground coat layer for coating directly onto the steel and a cover coat layer. The ground coat layer includes a soft ground coat frit having nickelous oxide dispersed substantially uniformly throughout. The resulting porcelain enamel coating provides good resistance to boiling defects, such as pinholes.

19 Claims, 1 Drawing Sheet

PORCELAIN ENAMEL COATING FOR HIGH-CARBON STEEL

CROSS-REFERENCE TO RELATED APPLICATIONS

This application claims priority to U.S. provisional Application Ser. No. 60/089,645, filed Jun. 17, 1998.

FIELD OF THE INVENTION

The present invention relates to porcelain enamel coatings used to coat sheet steel, and more particularly to multi-layered porcelain enamel coatings used to coat hot-rolled, high-carbon sheet steel substrates.

BACKGROUND PRIOR ART

In the past, it has been problematic to coat high-carbon, non-enamel grade steel with porcelain enamel coatings due to defects that occur during firing of such coatings. This is especially problematic when attempting to coat the steel using a single firing. Such defects are often caused by what is known as the primary boiling effect which can be observed during firing of porcelain enamel coatings. The primary boiling effect is caused by gaseous products of hydration and combustion of the carbon in the high-carbon steel sheet. These gases consist of carbon monoxide, carbon dioxide, hydrocarbons and traces of nitrogen. The boiling gases cause defects in the finished enamel coating, such as blisters, bubbles, voids, pinholes, boil-outs, copperheads and other defects. Such defects adversely affect the strength, weather resistance, corrosion resistance and appearance of the coating.

Additionally, such defects on the surface of the enamel coating may cause spalling due to freezing and thawing action of water which enters into the defects at the enamel surface. This initial spall can then open up more bubbles or pores and through subsequent freeze/thaw cycles produces more spalling.

It is believed that during the firing of the glass directly to the steel at elevated temperatures, water or moisture from a number of sources reacts with the steel to form hydrogen gas. During the high-temperature firing process of the porcelain enamel, the hydrogen gas formed by this reaction penetrates into the steel. After firing, and as the enamel coated steel is cooled, the hydrogen, being less soluble in the cooler steel, is discharged from the steel and builds up a pressure beneath the solidified enamel coating. This is especially problematic in cases where all of the surfaces of the steel substrate are coated with the enamel. The result is that the coating pops off in small flecks known as "fish scales" due to the pressure of the trapped gas. Defects which are caused by the trapped hydrogen are known as hydrogen defects.

U.S. Pat. No. 2,940,865 issued to Sullivan discloses the use of a thin layer of nickelous oxide coated on the steel substrate prior to enameling with a single layer of enamel. The stated function of the nickelous oxide layer is to reduce hydrogen defects and increase the adherence of a single thick layer of porcelain enamel coating to a steel base. The '865 patent discloses it is believed that the thin coating of nickelous oxide reacts with the water during the firing process away from the steel surface. Atomic hydrogen that is produced by the reaction, rather than penetrating into the steel, will combine to form molecular hydrogen which will not penetrate into the steel. It is also believed that the nickelous oxide layer is porous and is believed to resist the progress of the atomic hydrogen from penetrating into the steel so that the atomic hydrogen will combine into molecular hydrogen rather than penetrate into the steel.

However, it has been found that, with the layer of nickelous oxide as disclosed in the '865 patent, boiling defects, especially pinhole defects, may still occur in the single layer of porcelain enamel coating. Discontinuities, such as pinholes, in the porcelain enamel coating can expose the steel substrate, thereby subjecting it to corrosion. Accordingly, if discontinuity defects are minimized, then coating performance improves.

It would be desirable to provide for a porcelain enamel coating that would allow for the coating of higher carbon steel and reduce the defects in a porcelain enamel coating that are caused by the boiling of gases and trapped hydrogen pressure upon the porcelain enamel coating, as well as provide for desirable coating characteristics. It would also be desirable to provide such a coating which could be prepared in a single firing.

SUMMARY OF THE INVENTION

The current invention provides a multi-layered, functionally-gradient porcelain enamel coating which can be used to coat steel, including higher carbon, non-enamel-grade steel, that controls hydrogen defects and boiling defects in the finished coating. This invention permits coating all surfaces of a high-carbon steel sheet with minimal pinhole defects. The coating of the invention may also be prepared in a single firing.

One object and feature of the invention is to provide a multi-layer porcelain enamel coating including a ground coat having nickelous oxide mixed substantially uniformly therein to provide for resistance to hydrogen defects.

Another object and feature of the invention is to provide a porcelain enamel coating for coating higher carbon steel, the coating having increased resistance to defects caused by boiling of gases during the firing process.

Another object and feature of the invention is the use of a nickelous oxide layer underneath a multi-layered, functionally-gradient porcelain enamel coating having a soft ground coat and a hard cover coat.

Another object and feature of the invention is to provide a multi-layered, functionally-gradient porcelain enamel coating having a highly viscous cover coat such that during firing, the cover coat allows for smaller and fewer bubbles within the cover coat and thereby reduces the number of defects in the cover coat that may cause spalling due to freeze-thaw cycles. This permits use of the coating in applications such as water towers which may be subjected to freezing conditions.

One embodiment of the invention provides a multi-layered porcelain enamel coating composition for coating a steel substrate. The coating composition includes a ground coat layer of porcelain enamel for coating directly onto the steel, the ground coat layer including a soft ground coat frit and nickelous oxide separate from the frit dispersed substantially uniformly throughout the ground coat. The coating also includes a cover coat layer of porcelain enamel for coating over the ground coat layer, the cover coat layer including a hard frit.

In another embodiment of the invention, the coating composition is substantially the same as discussed above, but the nickelous oxide, rather than being mixed with the ground coat layer, is coated directly onto the steel substrate. The ground coat is then coated over the nickelous oxide layer, and the cover coat is coated over the ground coat. The ground coat and cover coat are fired together.

In other embodiments, a third layer, which is more dense than the cover layer, may be used to provide for further spall resistance by reducing the size and number of bubbles and other defects at the surface of the multi-layered enamel coating.

Figure 1:
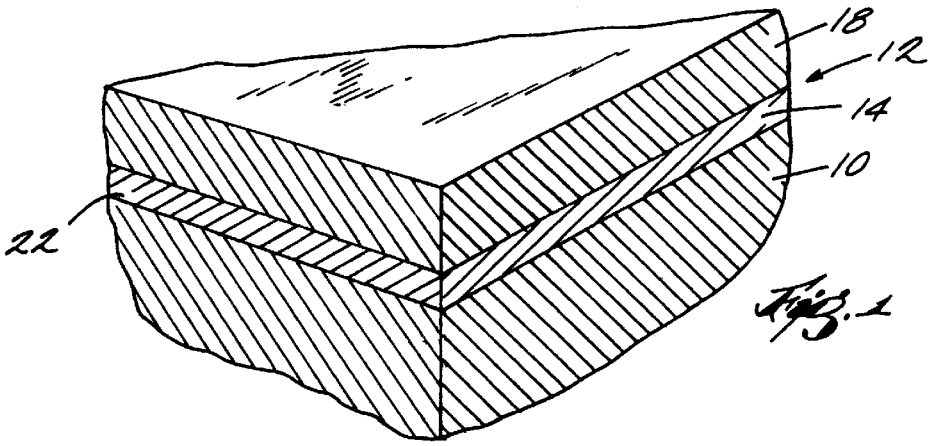
FIG. 1 is a fragmentary perspective view of a first embodiment of the invention showing a steel sheet coated with a two-layer porcelain enamel coating embodying the current invention.

Before embodiments in the invention are explained in detail, it is to be understood that the invention is not limited and that its application to the details of the composition or concentration of components, or to the steps or acts set forth in the following description. The invention is capable of other embodiments and of being practiced or being carried out in various ways. Also, it is understood that the phraseology and terminology used herein is for the purpose of description and should not be regarded as limiting.

DETAILED DESCRIPTION OF PREFERRED EMBODIMENTS

The invention generally relates to multi-layered porcelain enamel coatings which can be used to effectively coat high-carbon, hot-rolled steel.

Coatings embodying the invention include multiple layers of porcelain enamel coating wherein each layer is designed with specific characteristics to perform a specified function. This specified function is dependant upon a location in a layer relative to the steel surface. Additionally, nickelous oxide may be dispersed throughout the enamel layer closest to the steel substrate. In alternative embodiments, a nickelous oxide layer may be coated onto the steel substrate prior to enameling with a multi-layered, functionally-gradient porcelain enamel coating.

I. Steel Substrates

The steel substrates which may be coated can take the form of any steel, including very low carbon steels, such as ASTM porcelain enamel grade steels, or high-carbon steels. However, it is an advantage of the current invention that hot-rolled, heavy-gauged, higher carbon, and higher strength steels, which have traditionally been considered non-enamel grade steels, can be coated with enamel. Porcelain enamel coating of such non-enamel grade steels, as discussed above in the background of the invention, has been problematic due to carbides in the microstructure of the steel oxidizing and boiling out severely during the firing process. The coating of the current invention, however, can be used to effectively coat steel having a higher carbon content. Thus, the coating may be used with applications such as grain silos made of higher strength steel.

Nevertheless, as the carbon content of the steel is decreased, the quality of the finished coating generally increases. For better coating results, the carbon content is preferably less than about 0.30% carbon content. The upper portion of this range, however, is still higher carbon content than most traditional enamel-grade steels. Most notably, the coating can be used to effectively coat steel having a carbon content greater than about 0.1 weight percent. However, for the best coating results, the carbon content of the steel is less than about 0.1%, and is preferably less than about 0.08%.

In one embodiment, the steel substrate is high-strength, low-alloy, mild, hot-rolled sheet steel, having a carbon content between about 0.06% and about 0.08% and being between about 0.09 and 0.38 inches (0.2–0.97 centimeters) thick.

II. Pretreatment Processes

For better coating results, the substrate is preferably pretreated prior to enamel coating to remove impurities from, and roughen the surface of, the steel. Such pretreatment steps can occur prior to or after the steel substrate is formed and pressed into the desired shape. Numerous methods of pretreatment are known and can be used individually or in combination with each other. Such methods include grit-blasting, sand-blasting and abrasive-blasting the steel substrate. Other methods of pretreatment include pickling, acid-etching, degreasing, annealing and other methods of pretreatment known in the art.

A rust inhibitor may also be applied prior to coating the substrate. Additionally, the substrate is often dried thoroughly prior to coating.

III. One Embodiment of a Multi-layered Coating

A first embodiment of the invention is the two-layer porcelain enamel coating as depicted in FIG. 1. FIG. 1 illustrates a steel substrate 10 and a two-layer porcelain enamel coating 12 including a soft ground coat 14 and a hard cover coat 18. The ground coat 14 is coated onto the surface 22 of the steel substrate 10. The cover coat 18 is coated over the ground coat 14. The steel substrate 10 is preferably in accordance with those discussed above and was preferably pretreated in accordance with customary pretreatment processes.

The ground coat 14 should be thick enough to control gases emitted from the steel to prevent gas from disturbing the cover coat layer. Generally, the ground coat is in the range of between about 1 and about 5 mils (between about 0.03 and about 0.1 mm) in thickness and preferably between about 2 and about 3 mils (between about 0.05 and about 0.08 mm) in thickness. 1 mil =1/1000 inch=0.0254 millimeter. When wet, the ground coat is preferably at least about 2 mils (0.05 mm) thick; and is preferably about 3 to 5 mils (0.08 to 0.1 mm) thick. A relatively thick ground coat permits employing a wider variety of cover coats to meet a desired application. For example, the cover coat may be a spall resistant layer, a chemical resistant layer or simply a color layer. The ground coat should not be so thick, however, that it detracts from the appearance of the subsequent cover coat. When wet, a ground coat thickness of less than about 10 mils is preferred.

A. The Ground Coat

The ground coat 14 in the first embodiment is a porcelain enamel coating which is generally made up of a soft ground coat frit and from about 2 to about 10 weight percent nickelous oxide. Any necessary mill additions, such as suspending agents, electrolytes, refractories, coloring oxides and opacifiers may also be present in the ground coat, depending upon the deposition technique used and desired characteristics of the ground coat.

The frit used in the ground coat is preferably a soft frit, thereby making the ground coat a soft ground coat. The terms "soft" and "hard" in reference to the ground coat and the cover coat herein are in reference to the relative viscosity of the frits used in each of the coats. Relatively viscous frits are described as being "hard" while more fluid or less viscous frits are described as "soft". The relative viscosity of frit can be measured using ASTM C374 Fusion Flow Test. Using this test procedure, soft frits generally become fluid enough to flow a vertical distance of about 50 millimeters (mm) in about a 2 to 3 minute period at a temperature of between about 1300° F. (700° C.) and about 1400° F. (760° C.). Preferably, the soft frit used in the ground coat can flow this distance in this amount of time at a temperature between about 1300° F. (700° C.) and about 1350° F. (730° C.).

The soft ground coat is formulated with a soft frit to provide for good adherence to and good coverage of the steel. In this regard, the soft ground coat is formulated to wet the steel thoroughly to provide a good bond with the steel. Preferably, the frit has low melting and low surface tension properties which allow it to adhere well to the steel substrate.

Additionally, the less viscous soft frit in the ground coat can react to and close any deformation of the ground coat layer due to boiling of gases during the firing process. In this regard, the soft ground coat reduces the formation of pinholes, pores and large bubbles because the soft ground coat is fluid enough so that such deformations during the firing process are filled in by the fluid ground coat. The ability to react to fill defects provides for a better coating of the steel with fewer defects in the ground coat.

Suitable soft ground frits include most soft undercoating frits or ground coat frits known in the art. Generally, soft ground coat frits have higher boron content to provide for lower surface tension and hence better wetting of the steel. Additionally, soft frits generally are higher in sodium and other alkali metals which results in the soft frits having a lower melting temperature and lower viscosity.

Some of the preferred frits for use in the ground coat of the current invention include the following ingredients in weight percents approximately as listed:

TABLE 1

| Ingredient | General Range | Preferred Range | Most Preferred |
|---|---|---|---|
| $SiO_2$ | 35–50 | 40–45 | 44 |
| $Al_2O_3$ | 0–5 | 1–3 | 1.5 |
| $B_2O_3$ | 13–20 | 14–18 | 14.5 |
| $Na_2O$ | 0–28 | 20–26 | 21 |
| $K_2O$ | 0–20 | 2–4 | 3 |
| $Li_2O$ | 0–4 | 1–2 | 1.5 |
| $TiO_2$ | 0–6 | 2–4 | 4 |
| $P_2O_5$ | 0–6 | 2–4 | 2.5 |
| $CaF_2$ | 0–10 | 2–8 | 7 |
| MnO | 0–5 | 0–2 | 0.5 |
| NiO | 0–3 | 0–2 | 0 |
| CoO | 0–2 | 0–1 | 0.5 |
| CuO | 0–2 | 0–1 | 0 |
| $Fe_2O_3$ | 0–3 | 0–1 | 0 |

An alternate ground coat frit composition includes:

TABLE 2

| Ingredient | Ground Coat Frit (Weight %) |
|---|---|
| $Al_2O_3$ | 3 |
| $B_2O_3$ | 20 |
| CaO | 10 |
| $F_2$ | 3 |
| $K_2O$ | 2 |
| $Li_2O$ | 1 |
| $Na_2O$ | 20 |
| $SiO_2$ | 40 |
| CoO | 1 |
| TOTAL | 100 |

The ground coat 14 includes nickelous oxide mixed substantially uniformly throughout. The nickelous oxide is mixed into the ground coat prior to depositing the ground coat onto the steel, but is not smelted into or part of the soft frit. As discussed above, the nickelous oxide makes up from about 2 to about 10 weight percent of the total solids in the ground coat. Preferably, but not necessarily, the nickelous oxide is about 99.5% or greater in purity and has an average particle size of less than one micron and wherein 99.9% passes through a 325 mesh sieve.

It is believed that the nickelous oxide in the ground coat is an additive that acts to impede the progress of atomic hydrogen into the steel during the firing of the porcelain enamel coating. In theory, the nickelous oxide reacts with water during the firing thereby preventing the water from reacting with the iron in the steel to form hydrogen. The atomic hydrogen developed by this reaction occurs away from the surface of the steel. The atomic hydrogen, rather than penetrating into the steel during firing, will combine to form molecular hydrogen which will not penetrate into the steel. With the considerable lesser amount of hydrogen penetrating into the steel during firing, a lesser amount of hydrogen gas will build up beneath the solidified multi-layered coating after the firing process, and a correspondingly lesser amount of fish-scaling and other hydrogen defects occur in the finished coating.

The ground coat 14 can be deposited onto the substrate 10 in a broad variety of enamel deposition techniques known in the art. A preferred class of deposition techniques includes wet deposition techniques wherein the components of the ground coat are put into a liquid suspension, or "slip", and then applied to the steel substrate using various wet application methods. For enamels being applied by a wet processes, water is preferably used as the suspension medium. Mill additives, such as suspending agents, electrolytes and refractories are also preferably used to enhance the coating characteristics of the slip.

A preferred wet slip for the ground coat is generally made up of the following weight percent of solid components: from about 50 to about 90 weight percent of soft ground frit; from about 0 to about 30 weight percent of refractories; from about 3 to about 10 weight percent of suspending agent; from about 0.2 to about 1 weight percent of electrolytes; and from about 2 to about 10 weight percent of nickelous oxide. The above amounts are given in weight percent of total solids. These ingredients are dispersed in an aqueous medium to form an aqueous slip such that water makes up from about 25 to about 50 weight percent of the total slip solution.

Suitable soft ground frit for use in wet applications include the soft ground frits as discussed above.

Suitable refractories, suspending agents and electrolytes in the ground coat may include those generally known in the art that do not adversely affect the desired characteristics of the coating. The specific composition of the refractories, suspending agents and electrolytes is not critical. Representative refractories include silica, feldspar, alumina, zirconia and mixtures thereof. Representative suspending agents include clay, bentonite, and mixtures thereof. Representative electrolytes include sodium nitrate, borax, magnesium carbonate, sodium aluminate, potassium carbonate, potassium chloride and mixtures thereof.

The average particle size of the slip is routinely referred to in milling operations as fineness-of-grind and is given as a weight percent of the slip retained on a sieve of a certain mesh size. Preferably, the fineness is between about 2 and about 10 weight percent on a 200-mesh sieve. Finer and courser grinds are workable, but as the grind becomes finer, the solubility of the frit becomes an issue, and as the grind becomes courser, the frit particles will melt slower during firing and will not wet the steel as uniformly. More preferably, the fineness is between about 4 and about 6 percent on a 200-mesh sieve.

The viscosity of the slip can be adjusted, as appropriate, by the addition or subtraction of water or other ingredients to the formula as needed depending upon the desired consistency for the application technique used.

In preferred embodiments, the slip for the soft ground coat 14 comprises the ingredients and amounts as follows:

TABLE 3

| Ingredient | Possible Range | Preferred Range | Most Preferred |
|---|---|---|---|
| soft ground coat frit | 50–90 | 79–83 | 80.3 |
| refractories | 0–30 | 6–10 | 8.0 |
| suspending agents | 3–10 | 6–9 | 6.8 clay |
| Eg. clay, bentonite | 0.5–3 | 0.5–1.5 | 1.2 bentonite |
| nickelous oxide | 2–10 | 3–5 | 3.2 |
| electrolytes | 0.2–1 | 0.2–0.5 | 0.5 |
| water* | 25–50 | 35–45 | 40 |

*The amounts given in this table are given in weight percent of solid, except that water is given in weight percent of total.

The ground coat slip may be applied to the steel substrate by wet application techniques generally known in the art. Such techniques may include spraying, wet electrostatic spraying, dipping, flow coating, brushing, rollering or other applications as known in the art.

In one embodiment of the invention, the ground coat is preferably sprayed onto the steel substrate using a spray gun. From about 3 to about 50 grams of the ground coat slip is sprayed substantially uniformly onto the steel substrate per square foot of steel substrate. The lower limit to this range is usable, but the function of the ground coat as a soft ground coat is reduced. The upper limit to this range is also still very much workable, but the amount of cover coat will also have to be greater, and this becomes a question of practicality. Preferably, from about 10 to about 30 and, most preferably, about 15 to about 20 grams of slip is applied per square foot of steel substrate 10.

After the ground coat 14 has been applied to the steel substrate 10, the ground coat can be fired prior to application of the cover coat 18, or the cover coat 18 can be applied prior to firing, and then both the ground coat 14 and the cover coat 18 are fired with a single firing step. Preferably, the ground coat is not fired prior to the application of the cover coat, and both coats are fired in a single firing step.

After the ground coat is applied to the steel substrate, it is preferable not to allow the ground coat to substantially dry before the cover coat is applied. However, this is not absolutely necessary. A more uniform coat is easier to achieve over a wet ground coat because a dry ground coat tends to act like a sponge and absorb water from the cover coat. This tends to cause the cover coat to form small clumps on the surface, which may not melt evenly during firing.

B. The Cover Coat

The cover coat 18 is a porcelain enamel coating which is generally made up of a cover coat frit and any mill additions, such as suspending agents, electrolytes, refractories, coloring oxides and opacifiers as necessary, depending upon the deposition technique used and desired characteristics of the cover coat.

Suitable frits for use in the cover coat include most cover coat frits known in the art. Such frits may include cover coat frit having characteristics such as opacified frit, semi-opacified frit, clear frit, hard ground coat frit, decorative frit, corrosion resistant frit and mixtures thereof.

The frit used in the cover coat is preferably a hard frit, thereby making the cover coat a hard cover coat. As discussed above, the terms "soft" and "hard" in reference to the ground coat and the cover coat herein are in reference to the relative viscosity of the frits used in each of the coats. Using ASTM C374 Fusion Flow Test procedure, hard frits generally become fluid enough to flow a vertical distance of about 50 mm in about a 2 to 3 minute period at a temperature of between about 1450° F. and (790° C.) and about 1550° F. (840° C.). Preferably, the frit used in the cover coat can flow this distance in this amount of time at a temperature of about 1500° F. (820° C.). Additionally, the hard frits used in the cover coat should begin to soften at about 50° F. to 100° F. (25° C. to 60° C.) higher than the ground coat used.

Preferably, the hard cover coat is formulated with a hard frit to provide for good chemical resistance, weather resistance, color, strength, resistance to spalling and other desirable characteristics of a final coat of enamel. It is also preferable that the hard cover coat is formulated to be more viscous and denser to reduce the number and size of any bubbles in the cover coat, thereby reducing the size of any bubbles near the surface of the cover coat which helps to provide for good freeze/thaw spall resistance.

Generally, the cover coat frits have a lower sodium and other alkali metal content to provide for a higher melting temperature and higher viscosity. The boron content is generally lower to provide for better chemical resistance and higher viscosity. In some embodiments, higher amounts of titania ($TiO_2$) from between about 18 and about 22 percent are used in the cover coat frit to create an enamel which is denser such that any bubbles present in the cover coat are small.

Some of the preferred frits for use in the cover coat of the current invention include those with the following ingredients and with weight presents approximately as indicated.

TABLE 4

| | | | Most Preferred | |
|---|---|---|---|---|
| Ingredient | General Range | Preferred Range | Clear | Opaque |
| $SiO_2$ | 40–60 | 43–57 | 56 | 47 |
| $Al_2O_3$ | 0–5 | 0–2 | 1.5 | 0 |
| $B_2O_3$ | 8–16 | 10–14 | 11.5 | 13.5 |
| $Na_2O$ | 0–28 | 5–26 | 16 | 6.5 |
| $K_2O$ | 0–20 | 0–10 | 1 | 9 |
| $Li_2O$ | 0–4 | 0–2 | 2 | 0 |
| $TiO_2$ | 0–24 | 2–20 | 2 | 18 |
| $P_2O_5$ | 0–6 | 0–1 | 0 | 1 |
| $CaF_2$ | 0–10 | 0–2 | 2 | 0 |

TABLE 4-continued

| Ingredient | General Range | Preferred Range | Most Preferred Clear | Most Preferred Opaque |
|---|---|---|---|---|
| MnO | 0–5 | 0–1 | 1 | 0 |
| NiO | 0–3 | 0–2 | 1 | 0 |
| CoO | 0–2 | 0–1 | 1 | 0 |
| CuO | 0–2 | 0–1 | 1 | 0 |
| ZnO | 0–2 | 0–1 | 1 | 1 |
| $ZrO_2$ | 0–15 | 0–10 | 2 | 0 |
| $Fe_2O_3$ | 0–3 | 0–2 | 1 | 0 |
| $F_2$ | 0–6 | 0–4 | 0 | 4 |
| TOTAL | | | 100 | 100 |

As with the ground coat, the cover coat can be deposited onto the ground coat in a broad variety of enamel deposition techniques known in the art.

The cover coat can also be deposited using wet deposition techniques wherein the components of the cover coat are put into a slip and then applied to the ground coat using various wet application methods. For enamels being applied by wet processes, water is the preferred suspension medium. Mill additives to the frit, such as suspending agents, electrolytes and refractories, are generally necessary.

A wet slip for the cover coat is preferably made up of the following weight percent of solid components: from about 62 to about 96 weight percent of hard frit; from about 0 to about 25 weight percent of refractories; from about 2 to about 10 weight percent of suspending agent; from about 0.2 to about 1 weight percent of electrolytes; and from about 0 to about 10 weight percent pigments. The above amounts are given in weight percent of solids. These ingredients are preferably dispersed in an aqueous solution such that water makes up from about 25 to about 35 weight percent of the total solution.

Suitable cover coat frit includes the cover coat frits as discussed above.

Suitable refractories in the cover coat may include most refractories generally known in the art that do not adversely affect the desired characteristics of the coating. Preferable refractories include silica, feldspar, alumina, zirconia and mixtures thereof.

Suitable suspending agents may include most suspending agents generally known in the art that do not adversely affect the desired characteristics of the coating. Preferable suspending agents include clay, bentonite, and mixtures thereof.

Suitable electrolytes may include most electrolytes generally known in the art that do not adversely affect the desired characteristics of the coating. Preferable electrolytes include sodium nitrate, borax, magnesium carbonate, sodium aluminate, potassium carbonate, potassium chloride, potassium phosphate and mixtures thereof.

Suitable pigments may include most pigments generally known in the art that do not adversely affect the desired characteristics of the coating depending upon the desired color and appearance of the cover coat. Preferred pigments include zirconia, titania, ceramic pigments, color oxides such as black color oxides and blue color oxides, but other pigments could be used. For example, titanium dioxide could be used for whites or pastels. Additionally, opacifiers for gloss or opacity control may also be used.

As discussed above in the ground coat, the average particle size of the slip is routinely referred to in milling operations as fineness-of-grind and is given as a weight percent of the slip retained on a sieve of a certain mesh size. Preferably, the fineness of the cover coat is between about 2 and about 10 weight percent on a 200-mesh sieve. Finer and courser grinds are workable, but as the grind becomes finer, the solubility of the frit becomes an issue, and as the grind becomes courser, the frit particles will melt slower and not as uniformly. More preferably, the fineness of the cover coat slip is between about 5 and about 7 percent on a 200-mesh sieve.

The viscosity of the cover coat slip can be adjusted, as appropriate, by the addition or subtraction of water or other ingredients to the formula as needed depending upon the desired consistency for the application technique used.

In preferred embodiments, the slip for the cover coat comprises the ingredients and amounts as follows:

TABLE 5

| Ingredient | General Range | Preferred Range | Most Preferred Clear | Most Preferred Opaque |
|---|---|---|---|---|
| cover coat frit | 62–96 | 70–95 | 71.4 | 87.3 |
| refractories | 0–25 | 1–16 | 14.3 | 8.7 silica |
| suspending agents | 2–10 | 3–6 | clay | |
| eg. clay bentonite | | | 4.8 | 3.5 |
| | | | bentonite | |
| | | | 0.1 | 0.3 |
| electrolytes | 0.2–1 | 0.2–0.5 | 0.4 | 0.2 |
| colorants & opacifiers | 0–10 | 0–9 | 8.9 | 0 |
| water* | 25–35 | 20–30 | 25 | 30 |

*The amounts given in this table are given in weight percent of total solid, except that water is given in weight percent of total solution.

The cover coat slip may be applied to the ground coat by wet application techniques generally known in the art. Such techniques may include spraying, wet electrostatic spraying, dipping, flow coating, brushing, rollering or other applications as known in the art.

Preferably, the cover coat 18 was sprayed onto the ground coat 14 on the substrate 10 using a spray gun. The amount of cover coat applied is dependent upon the desired finished thickness of the cover coat, and the thickness of the cover coat is dependent upon the finished thickness of the ground coat. Preferably, from about 20 to about 90 grams of cover coat slip is sprayed substantially uniformly onto the ground coated substrate per square foot of substrate. As discussed above, the lower limit to this range is usable, but the function of the ground coat as a soft ground coat is reduced, and the upper limit is also still very much workable, but the amount of cover coat becomes very great, and this becomes a question of practicality. More preferably, from about 30 to about 70 and, most preferably, about 45 grams of cover coat slip is sprayed substantially uniformly onto the ground coated substrate per square foot of substrate.

After the cover coat has been applied to the ground coated steel substrate, the cover coat is dried using drying methods generally known in the art. Preferably, the cover coat is dried by placing the coated substrate in an infrared convection heater at a temperature of between about 200° F. (90° C.) to about 400° F. (200° C.) for about 10 minutes or until substantially all of the water is removed.

After the ground coat is dry, it is fired. As discussed above, the ground coat can be fired prior to application of the cover coat, or the cover coat and ground coat can be fired with a single final firing step. Preferably, the ground coat is not fired prior to the application of the cover coat, and both coats are fired in a single firing step.

The firing of the coatings occurs as generally known in the art for the firing of porcelain enamel coatings. The possible times and temperatures for use in the firing step are dependent upon the thickness of the enamel coatings, the thickness of the steel substrate, the composition of the enamel coatings and the desired properties of the enamel coatings.

For most substrates, the temperatures for firing preferably ranges from about 1500° F. (820° C.) to about 1700° F. (930° C.), and the length of time of the firing preferably ranges from about 5 to about 15 minutes. Most steel sheets used as the substrate in the current embodiment range from about 0.09 to about 0.375 inches (0.2 to 0.95 centimeters) thick. The temperature and time of firing for sheets of steel between 0.09 and 0.375 inches (0.2 to 0.95 centimeters) generally fall within endpoint ranges as follows: for thinner sheets of steel around about 0.09 inches (0.2 centimeters) thick, it is preferable to fire at a temperature from about 1560° F. (850° C.) to 1600° F. (870° C.), for about 6 to about 8 minutes, and most preferably at about 1580° F. (860° C.) for about 7 minutes; and for thicker sheets of steel of about 0.375 inches (0.95 centimeters) thick, it is preferable to fire at a temperature between about 1580° F. (860° C.) and about 1620° F. (880° C.) for between about 12 to about 14 minutes and, most preferably, at about 1600° F. (870° C.) for about 13 minutes.

It should be understood, however, that the current invention could be used to coat thinner or thicker sheets of steel or could be used to coat structural steel members which are not sheet steel and are much thicker. For such applications, it will be understood by those skilled in the art that the firing temperatures and times for such applications may fall outside of the preferred ranges given above.

The fired thickness of the ground coat is generally in the range of between about 1 and about 5 mils and preferably between about 2 and about 3 mils. The total fired thickness of the ground coat and cover coat combined is generally about 6 to 15 mils.

IV. A Second Embodiment of a Multi-layered Coating

Figure 2:
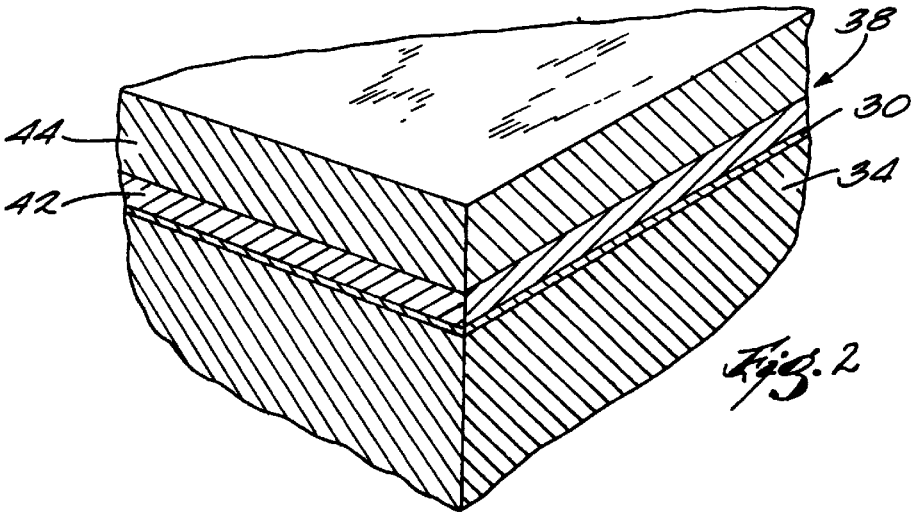
FIG. 2 is a fragmentary perspective view of a second embodiment of the invention showing a steel sheet coated with a layer of nickelous oxide and a two-layered porcelain enamel coating embodying the current invention.

FIG. 2 shows a second embodiment of the current invention having a nickelous oxide layer 30 coated onto a steel substrate 34 and a two-layer porcelain enamel coating 38 coated over the nickelous oxide layer 30. The two-layer coating 38 includes a soft ground coat 42 coated over the nickelous oxide layer 30 and a hard cover coat 44 coated over the ground coat 42.

The nickelous oxide is not incorporated within the porcelain enamel ground coat as in the first embodiment but instead makes up the nickelous oxide layer 30 that is first coated onto the steel substrate, as disclosed in U.S. Pat. No. 2,940,865. The nickelous oxide layer is coated onto the steel substrate in substantially the same way as disclosed in U.S. Pat. No. 2,940,865, which is hereby incorporated herein by reference.

The ground coat 42 composition usable in this embodiment is substantially the same as the ground coats 14 usable in the first embodiment as disclosed above but without the nickelous oxide added thereto. Additionally, the cover coat 44 composition usable in this embodiment is substantially the same as the cover coats 18 usable in the first embodiment as disclosed above. The steel substrate, the process of preparing the steel substrate and the methods and processes for coating and firing the ground coat and the cover coat are also generally the same as discussed above with regard to the first embodiment. In this embodiment, the ground coat and cover coat are fired simultaneously. This second embodiment is intended to show that many of the features and advantages of the current multi-layered porcelain enamel coating invention are still realized when the nickelous oxide is not dispersed throughout the ground coat but is instead coated directly onto a steel substrate. It should be realized, however, that mixing the nickelous oxide within the ground coat is preferred.

V. A Third Embodiment of a Multi-layered Coating

Figure 3:
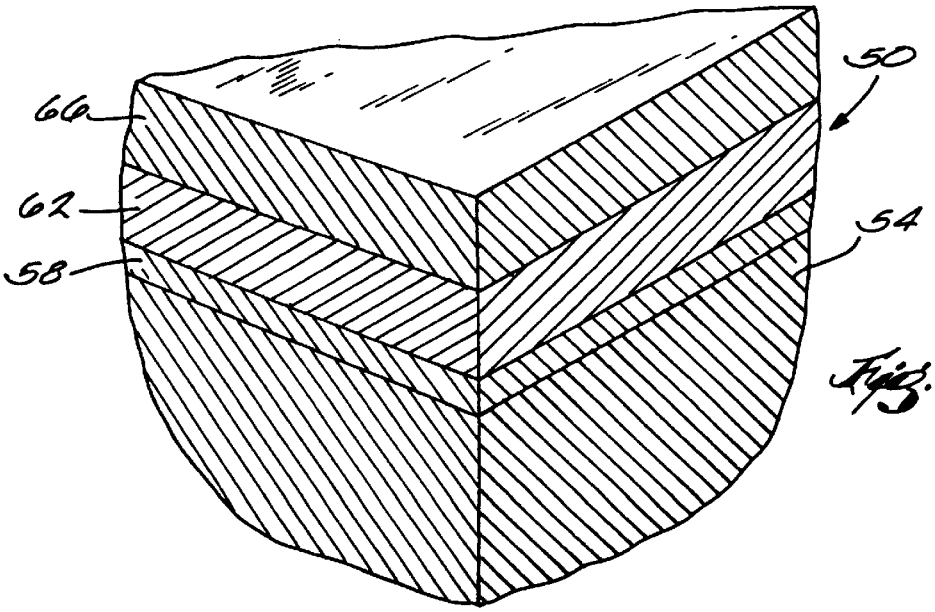
FIG. 3 is a fragmentary perspective view of a third embodiment of the invention showing a steel sheet coated with a three-layered porcelain enamel coating embodying the current invention.

FIG. 3 illustrates a third embodiment of the current invention showing a three-layer porcelain enamel coating 50 on a steel substrate 54. The three-layer coating 50 includes a soft ground coat 58 coated onto the substrate 54 and a hard cover coat 62 coated over the ground coat 58. The soft ground coat 58 is substantially the same as the ground coats disclosed above in the first embodiment, and the hard cover coat 62 is substantially the same as the cover coats disclosed above in the first embodiment.

A third coat of porcelain enamel 66 is coated over the cover coat 62. The third coat 66 is significantly harder and more viscous than the ground coat 58 and the cover coat 62. This highly viscous third coat 66 allows fewer bubbles and smaller size bubbles during firing and thus provides for fewer boiling defects and is more resistant to spalling. In a preferred embodiment, the frit used in the third coat 66 is the Titanium Opacified Coat frit as disclosed in the cover coat table above.

This third embodiment of the invention also illustrates that the invention is not limited to embodiments having two porcelain enamel coats and that more than two porcelain enamel coats may be used. It should also be understood that the highly viscous layer of this embodiment may be included in other two-layer embodiments having only a soft ground coat, as in the first embodiment, and the highly viscous coat as the cover coat.

Another contemplated embodiment includes the use of a nickelous oxide layer coated directly onto the steel substrate followed by a soft ground coat, a cover coat and a highly viscous third coat. Additionally, another contemplated embodiment may include a soft ground coat having nickelous oxide mixed therein, as in the first embodiment, coated directly onto the substrate and a highly viscous outer layer that, during firing, provides for smaller bubbles and is thus more resistant to spalling.

Although only a few embodiments of the invention have been described, it should be understood that the invention is not intended to be limited to the specific embodiments illustrated. Those of ordinary skill in the art will recognize that the embodiment described above may be modified and altered without departing from the central spirit and scope of the invention. Thus, the embodiments described above are to be considered in all respects as illustrative and not restrictive, the scope of the invention being indicated by the claims rather than by the foregoing description, and all changes which come within the meaning and range of equivalency of the claims are intended to be embraced herein.

EXAMPLES

Example 1

The steel substrate is pretreated using the following series of pretreatment steps. The substrate is first steel-grit blasted. Next, the steel substrate is formed or pressed into the desired shape and degreased in a multi-stage alkaline wash, including at least two wash steps. Generally, these alkaline washes occur in alkaline baths that are about 5% aqueous solutions of commercial degreasing agents which consist of sodium silicates, soda ash, caustic soda and occasionally sodium phosphates. Additionally, surface active agents such as wetting agents and emulsifiers are generally used. After degreasing, the substrate is thoroughly washed in water, at least twice, to remove all the residues of the degreasing agents. A rust inhibitor including about 0.5% sodium nitrate is applied in the final rinse. After the final rinse, the substrate is dried in a heated dryer at a temperature between about 150° F. (65° C.) and about 220° F. (100° C.) for about 1 to about 3 minutes. A ground coat is prepared to have the following frit composition:

| Ingredient | Ground Coat Frit (Weight %) |
|---|---|
| $Al_2O_3$ | 1.5 |
| $B_2O_3$ | 14.5 |
| $CaF_2$ | 7 |
| $K_2O$ | 3 |
| $Li_2O$ | 1.5 |
| MnO | 0.5 |
| $Na_2O$ | 21 |
| $P_2O_5$ | 2.5 |
| $SiO_2$ | 44 |
| $TiO_2$ | 4 |
| CoO | 0.5 |
| TOTAL | 100 |

A slip is prepared from the frit and comprises the following ingredients:

| Ingredient | Weight Percent |
|---|---|
| soft ground coat frit | 80.3 |
| silica | 8.0 |
| clay | 6.8 |
| bentonite | 1.2 |
| nickelous oxide | 3.2 |
| electrolytes | 0.5 |
| Water* | 40 |

*The amounts given in this table are given in weight percent of solid, except that water is given in weight percent of total.

The ground coat slip is applied wet to a thickness of 3–5 mils using a spray gun (about 15–20 grams of slip per square foot of steel substrate).

A cover coat slip is prepared having the following ingredients:

| Ingredient | Weight Percent |
|---|---|
| cover coat frit | 87.3 |
| silica | 8.7 |
| clay | 3.5 |
| bentonite | 0.3 |
| electrolytes (e.g. borax, magnesium carbonate, potassium phosphate) | 0.2 |
| colorants and opacifiers | 0 |
| Water* | 30 |

*The amounts given in this table are given in weight percent of total solid, except that water is given in weight percent of total solution.

The cover coat frit composition is as follows:

| Ingredient | Weight Percent |
|---|---|
| $SiO_2$ | 56 |
| $Al_2O_3$ | 1.5 |
| $B_2O_3$ | 11.5 |
| $Na_2O$ | 16 |
| $K_2O$ | 1 |
| $Li_2O$ | 2 |
| $TiO_2$ | 2 |
| $CaF_2$ | 2 |
| MnO | 1 |
| NiO | 1 |
| CoO | 1 |
| CuO | 1 |
| ZnO | 1 |
| $ZrO_2$ | 2 |
| $Fe_2O_3$ | 1 |
| Total | 100 |

The wet cover coat slip is applied over the ground coat using a spray gun and to a thickness of about 45 grams per square foot of substrate. The sample is then fired. When the sample is about 0.25 inch (0.64 centimeters) thick, the sample is fired at 1600° F. (870° C.) for about 13 minutes.

Example 2

Steel sheets (45 square foot each) were coated with porcelain enamel as described in Example 1. The steel sheets were mild and high-strength low-allow (HSLA) steel (thickness of from 0.094 to 0.375 inch (0.24 to 0.955 centimeters) and carbon at 0.1 percent). The resulting coated sheets were tested for discontinuity defects. A discontinuity defect is a break in the continuity of the coating from the surface of the porcelain enamel to the metal substrate. Defects are detected by connecting one lead of an ohmmeter or similar device for detecting an electrical current to the steel substrate. The other lead is embedded in a sponge moistened with water that is rubbed across the entire surface of the coating. When a defect in the coating allows the water to touch the substrate, the electrical circuit is completed and can be detected by the ohmmeter.

A preferred method based on ISO 8289 uses a highly sensitive instrument that consists of a low 9V direct current, an earth lead, an electrode attached to a sponge moistened with water, and a current flow sensor. In a production test using 1000 45-square-foot sheets only eight sheets (less than 1%) were found to contain more than five discontinuity defects.

Example 3

Carbon steel substrates (7 inch by 7 inch) (18 centimeter× 18 centimeter) were coated with porcelain enamel substantially as described in Example 1. One side was coated with the preferred opaque cover coat and the other side was coated with the preferred clear cover coat as shown in Table 4 above. The samples were taken from 0.094-inch thick high-strength low-alloy (HSLA) steel panels (5 foot×5 foot) (152 centimeters×152 centimeters).

The ground coat was spray applied at about 16 to 20 grams per square foot. The cover coats at about 40 to 50 grams per square foot. The large panels were fired in a continuous gas fired furnace at about 1550° F. for about 8 minutes. Total fired enamel thickness of about 0.010 inches (0.25 mm) on both sides. The resulting coatings were frost spall tested.

Frost spall testing is accomplished by clamping two (7 inch by 7 inch) (18 centimeter×18 centimeter) enameled steel panels together with the surfaces to be tested facing each other. A gasket material is clamped between the panels and is used to create a gap for water. While the gap is filled with water, the samples are placed in a freezer chamber, and cycled such that the water freezes and thaws one time during each cycle. After a predetermined number of cycles, the samples are removed, and the number of spalls is counted on each panel. Any chip in the glass surface is counted as a spall. After this evaluation, the samples are placed back into the chamber, cycled to another endpoint, and re-evaluated. This can be repeated as often as necessary. The samples of the opaque cover coat were nearly spall-free after 750 cycles.

We claim:

1. A multi-layered porcelain enamel coating composition for coating a steel substrate, said coating composition comprising:

a ground coat layer of porcelain enamel for coating directly onto the steel substrate, said ground coat layer including a soft ground coat frit and nickelous oxide separate from the frit dispersed substantially uniformly throughout the ground coat layer, wherein the ground coat layer comprises from about 2 to about 10 weight percent nickelous oxide; and a cover coat layer of porcelain enamel for coating over the ground coat layer, the cover coat layer including a hard cover coat frit.

2. The multi-layered porcelain enamel coating of claim 1 wherein the steel substrate has a carbon content of at least about 0.1 weight percent.

3. The multi-layered porcelain enamel coating of claim 1 wherein the steel substrate has a carbon content of between about 0.1 and about 0.3 weight percent.

4. The multi-layered porcelain enamel coating of claim 1 wherein the ground coat layer is between about 1 mils (0.03 millimeters) and about 5 mils (0.1 millimeters) thick.

5. The multi-layered porcelain enamel coating of claim 1 further including:

a third layer of porcelain enamel for coating over the cover coat layer, the third layer including a hard frit which is denser than the cover coat frit to minimize the formation of large bubbles in the third coat during firing of the porcelain enamel coating.

6. The multi-layered porcelain enamel coating of claim 1 wherein the hard frit of the cover coat layer is denser than the soft frit in the ground coat layer so as to prevent the formation of large bubbles in the cover coat during firing of the porcelain enamel coating.

7. The multi-layered porcelain enamel coating of claim 1 wherein the ground coat layer and the cover coat layer are fired simultaneously.

8. A multi-layered porcelain enamel coating composition for coating a steel substrate, said coating composition comprising:

a layer of nickelous oxide coated directly onto the steel substrate;

a ground coat layer of porcelain enamel for coating directly onto the nickelous oxide coated steel, said ground coat layer including a soft ground coat frit; and a cover coat layer of porcelain enamel for coating over the ground coat layer, the cover coat layer including a hard frit, wherein the ground coat layer and the cover coat layer are fired simultaneously in a single firing.

9. The multi-layered porcelain enamel coating of claim 8 wherein the steel substrate has a carbon content of up to about 0.3 weight percent.

10. The multi-layered porcelain enamel coating of claim 8 wherein the steel substrate has a carbon content of between about 0.1 and about 0.3 weight percent.

11. The multi-layered porcelain enamel coating of claim 8 further including:

a third layer of porcelain enamel for coating over the cover coat layer, the third layer including a hard frit which is denser than the cover coat frit to prevent the formation of large bubbles in the third coat during firing of the porcelain enamel coating.

12. The multi-layered porcelain enamel coating of claim 8 wherein the hard frit of the cover coat layer is denser than the soft frit in the ground coat layer so as to prevent the formation of large bubbles in the cover coat during firing of the porcelain enamel coating.

13. A method for applying a multi-layered porcelain enamel coating to a steel substrate comprising the steps of:

providing the steel substrate;

providing a porcelain enamel ground coat composition including a soft ground coat frit and nickelous oxide separate from the frit and mixed substantially uniformly into the ground coat composition;

applying the ground coat composition to the steel substrate to form a ground coat;

providing a porcelain enamel cover coat composition including a hard cover coat frit;

applying the cover coat composition onto the ground coat to form a cover coat; and firing the substrate to fuse the multi-layered porcelain enamel coating to the steel.

14. The method of claim 13 wherein the steel substrate has a carbon content greater than about 0.1 weight percent.

15. The method of claim 13 wherein the ground coat composition includes from about 2 to about 10 weight percent nickelous oxide.

16. The method of claim 13 wherein the ground coat has a thickness between about 1 mil (0.03 millimeters) and about 5 mils (0.1 millimeters) after being fired.

17. The method of claim 13 wherein the steel substrate has a top side and a bottom side, and the ground coat composition covers the top side and the bottom side of the steel substrate.

18. A multi-layered porcelain enamel coating on a steel substrate formed by the process comprising the steps of:

providing the steel substrate;

providing a porcelain enamel ground coat composition including a soft ground coat frit;

admixing nickelous oxide to the porcelain enamel ground coat composition applying the ground coat composition including the nickelous oxide to the steel substrate to form a ground coat;

providing a porcelain enamel cover coat composition including a hard cover coat frit;

applying the cover coat composition onto the ground coat to form a cover coat; and firing the substrate to fuse the multi-layered porcelain enamel coating to the steel.

19. The coating of claim 18 wherein the nickelous oxide is separate from the ground coat frit and dispersed substantially uniformly throughout the ground coat.

* * * * *